US011680502B2

(12) United States Patent
Kondo

(10) Patent No.: US 11,680,502 B2
(45) Date of Patent: Jun. 20, 2023

(54) MUFFLER

(71) Applicant: FUTABA INDUSTRIAL CO., LTD., Okazaki (JP)

(72) Inventor: Seiji Kondo, Okazaki (JP)

(73) Assignee: FUTABA INDUSTRIAL CO., LTD., Okazaki (JP)

( * ) Notice: Subject to any disclaimer, the term of this patent is extended or adjusted under 35 U.S.C. 154(b) by 89 days.

(21) Appl. No.: 17/168,341

(22) Filed: Feb. 5, 2021

(65) Prior Publication Data

US 2021/0246818 A1 Aug. 12, 2021

(30) Foreign Application Priority Data

Feb. 12, 2020 (JP) ..... JP2020-021640

(51) Int. Cl.
*F01N 1/04* (2006.01)
*G10K 11/162* (2006.01)

(52) U.S. Cl.
CPC ..... *F01N 1/04* (2013.01); *G10K 11/162* (2013.01); *F01N 2310/02* (2013.01); *F01N 2470/02* (2013.01)

(58) Field of Classification Search
CPC .. F01N 2470/02; F01N 2470/24; F01N 1/026; F01N 1/04; F01N 1/10; F01N 2310/02; F01N 1/125; F01N 1/24; F01N 2470/04; F01N 2470/08; G10K 11/162
See application file for complete search history.

(56) References Cited

U.S. PATENT DOCUMENTS 2,043,731 A * 6/1936 Bourne ..... F01N 1/006 89/14.4
3,154,388 A * 10/1964 Purse ..... F01N 3/2885 422/177
3,964,570 A * 6/1976 Morrow ..... F01N 1/10 181/268
4,580,656 A * 4/1986 Fukuda ..... F01N 1/006 181/252

(Continued)

FOREIGN PATENT DOCUMENTS

DE 976032 C * 1/1963
DE 4011753 A1 * 10/1990

(Continued)

OTHER PUBLICATIONS

English transaltion of JP-2008031921-A; accessed Dec. 12, 2022 via Espacenet; <https://worldwide.espacenet.com/patent/search/family/039121624/publication/JP2008031921A?q=2008031921> (Year: 2008).*

(Continued)

*Primary Examiner* — Jeremy A Luks
(74) *Attorney, Agent, or Firm* — Withrow & Terranova, P.L.L.C.; Vincent K. Gustafson

(57) ABSTRACT

A muffler includes an exhaust pipe, a shell, and a cover. The exhaust pipe includes communication holes and is configured to allow an exhaust gas to flow through an interior of the exhaust pipe. The shell is disposed outside the communication holes to cover the communication holes. The cover has a tubular shape. The cover is disposed between the exhaust pipe and the shell. The cover is disposed at a distance, which is specified in advance, from the exhaust pipe.

6 Claims, 6 Drawing Sheets

(56) References Cited

U.S. PATENT DOCUMENTS

| | | | | | |
|---|---|---|---|---|---|
| 5,892,186 | A * | 4/1999 | Flugger | F01N 1/10 | 181/269 |
| 8,256,569 | B1 * | 9/2012 | Huff | F01N 1/026 | 181/252 |
| 8,485,314 | B2 * | 7/2013 | Danner | F01N 13/16 | 181/246 |
| 2008/0308347 | A1 * | 12/2008 | Luttig | F01N 1/08 | 181/253 |
| 2011/0024228 | A1 * | 2/2011 | Murakami | F01N 13/009 | 181/249 |
| 2021/0047951 | A1 * | 2/2021 | Anderson | F01N 1/24 | |

FOREIGN PATENT DOCUMENTS

| | | | | |
|---|---|---|---|---|
| EP | 1442905 | A2 * | 8/2004 | F01N 1/084 |
| EP | 2166203 | A1 * | 3/2010 | B01D 53/944 |
| FR | 1343005 | A * | 11/1963 | |
| JP | S60240816 | A | 11/1985 | |
| JP | S62160716 | U | 10/1987 | |
| JP | 2008031921 | A * | 2/2008 | |
| JP | 2008138608 | A | 6/2008 | |
| KR | 20080006541 | U * | 12/2008 | |

OTHER PUBLICATIONS

Notice of Reasons for Refusal for Japanese Patent Application No. 2020021640, dated Feb. 15, 2022, 8 pages.
First Office Action for Chinese Patent Application No. 202110178804.0, dated Aug. 2, 2022, 8 pages.

* cited by examiner

MUFFLER

CROSS-REFERENCE TO RELATED APPLICATIONS

This application claims the benefit of Japanese Patent Application No. 2020-21640 filed on Feb. 12, 2020 with the Japan Patent Office, the entire disclosure of which is incorporated herein by reference.

BACKGROUND

The present disclosure relates to a muffler.

Japanese Unexamined Patent Application Publication No. 2008-138608 discloses a muffler in an exhaust system of an internal combustion engine for the purpose of noise reduction. The muffler includes an exhaust pipe having several holes.

SUMMARY

The muffler described in Japanese Unexamined Patent Application Publication No. 2008-138608 facilitates muffling effect on a sound in a specific frequency by increasing the number of holes on an exhaust pipe or increasing an area of the holes. However, such increase in the number or area of the holes in the exhaust pipe causes reflection of sound waves at the holes within the exhaust pipe. This makes it likely to form nodes in standing waves within the exhaust pipe. As a result, such a muffler may be incapable of achieving the muffling effect on a sound in a specific frequency intended to be dampened.

In one aspect of the present disclosure, it is preferable to provide a muffler capable of muffling effect in a specific frequency while reducing generation of a node of a standing wave.

In one embodiment of the present disclosure, a muffler comprises an exhaust pipe, a shell, and a cover. The exhaust pipe includes communication holes and is configured to allow an exhaust gas to flow through an interior of the exhaust pipe. The shell is disposed outside the communication holes to cover the communication holes. The cover has a tubular shape. The cover is disposed between the exhaust pipe and the shell and at a specific distance from the exhaust pipe. The cover covers at least one of the communication holes.

In the configuration as described above, the cover is placed in a position where a node of a standing wave is to be formed when the communication holes are covered with the shell. This restricts reflection of sound waves in an area where the cover overlaps the communication holes in the exhaust pipe, comparing with a case in which the communication holes are covered with the shell alone. Accordingly, generation of a node of a standing wave is reduced. As a result, the configuration as described above enables muffling effect in a specific frequency while reducing generation of a standing wave with a new frequency.

In one embodiment of the present disclosure, each of the exhaust pipe and the cover may have a cylindrical shape. The exhaust pipe and the cover may have a common central axis. Further, a diameter of the exhaust pipe may be set to not less than 1.8 times larger than a distance between the exhaust pipe and the cover.

By such a configuration, a higher muffling effect can be obtained, comparing with conventional configurations. This is shown in experimental results, which will be described below.

In one embodiment of the present disclosure, both ends of the cover in an axial direction of the exhaust pipe may be fixed to the exhaust pipe.

By such a configuration, misalignment and vibrations of the cover can be limited. This further enhances an inhibiting effect on generation of a node of a standing wave and muffling effect.

In one embodiment of the present disclosure, at least one of the both ends of the cover in the axial direction of the exhaust pipe may be configured as an open end, which includes a gap between the cover and the exhaust pipe.

In the configuration as described above, the gap between the exhaust pipe and the cover is also formed around the open end of the cover, which is open to an outer peripheral surface of the exhaust pipe. In this case, an opening (gap) of the open end of the cover may also serve as one of auxiliary holes, which will be described below. Accordingly, an area available for forming the auxiliary holes is increased in the cover, thereby allowing for facilitation of the muffling effect in the muffler.

In one embodiment of the present disclosure, the cover may include the auxiliary holes disposed in a part facing the outer peripheral surface of the exhaust pipe.

By such a configuration, a flow of the exhaust gas between the cover and the shell can be ensured. Consequently, the exhaust gas is expanded between the cover and the shell, thereby allowing for facilitation of the muffling effect.

In one embodiment of the present disclosure, the muffler may further comprise a sound absorbing material disposed between the exhaust pipe and the cover. The sound absorbing material covers the communication holes.

By such a configuration, the sound absorbing material limits vibrations produced by the exhaust gas, thereby allowing for facilitation of the muffling effect.

BRIEF DESCRIPTION OF THE DRAWINGS

An example embodiment of the present disclosure will be described hereinafter by way of example with reference to the accompanying drawings, in which.

DETAILED DESCRIPTION OF EXEMPLARY EMBODIMENTS

1. Embodiment

1-1. Configuration

Figure 1:
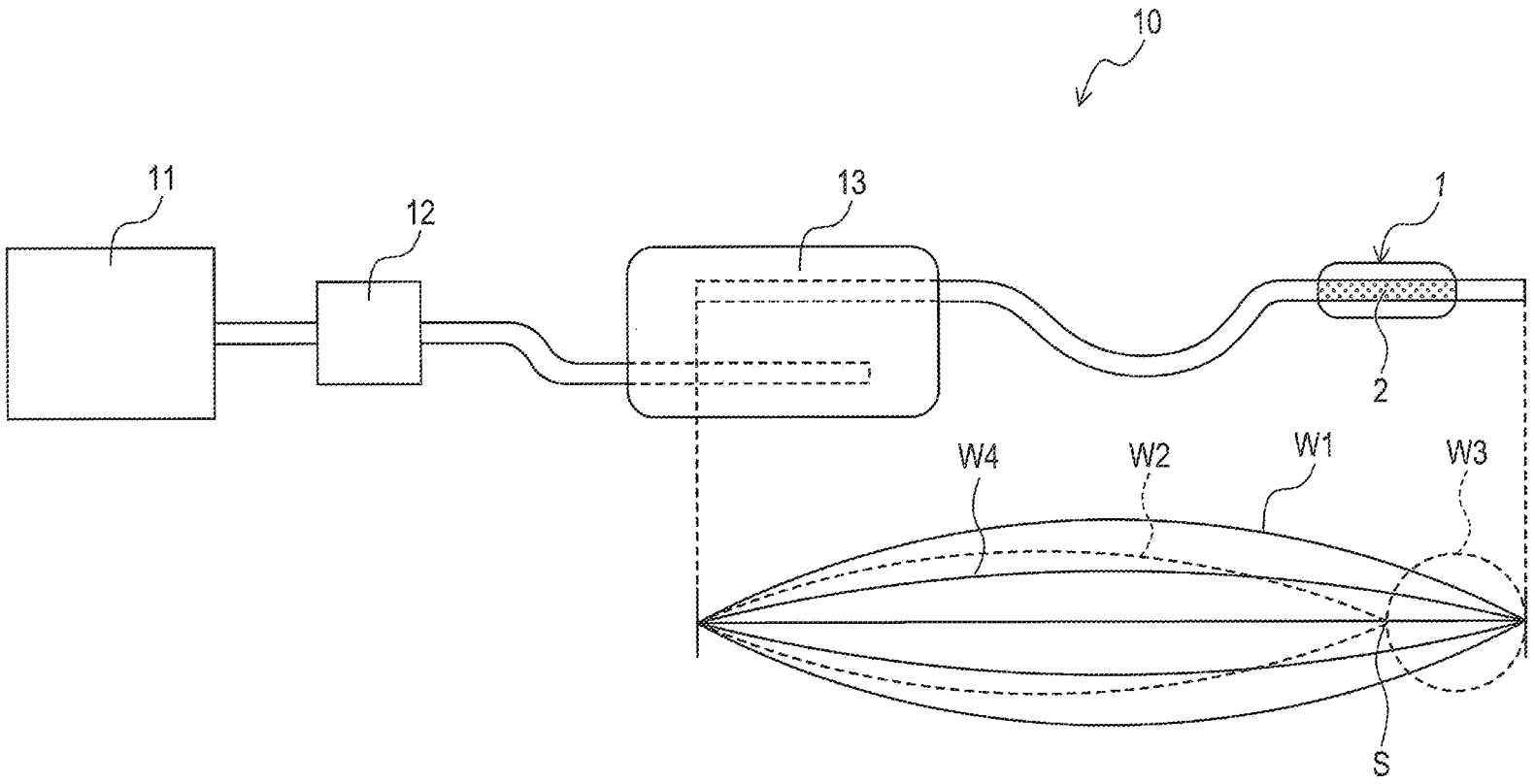
FIG. 1 is a schematic diagram showing an exhaust system of an embodiment.

An exhaust system 10 shown in FIG. 1 forms an exhaust flow passage for an internal combustion engine 11. The exhaust system 10 comprises a catalytic converter 12, a main muffler 13, and a muffler 1 as a sub-muffler.

The internal combustion engine 11 to which the exhaust system 10 is applied is not particularly limited, and includes transportation equipment such as automobiles, railways, vessels, and construction machines, and engines used for drivers or generators in power facilities.

The muffler 1 is disposed downstream of the main muffler 13. However, the muffler 1 may be disposed upstream of the main muffler 13. For example, the muffler 1 may be disposed between the catalytic converter 12 and the main muffler 13.

Figure 2:
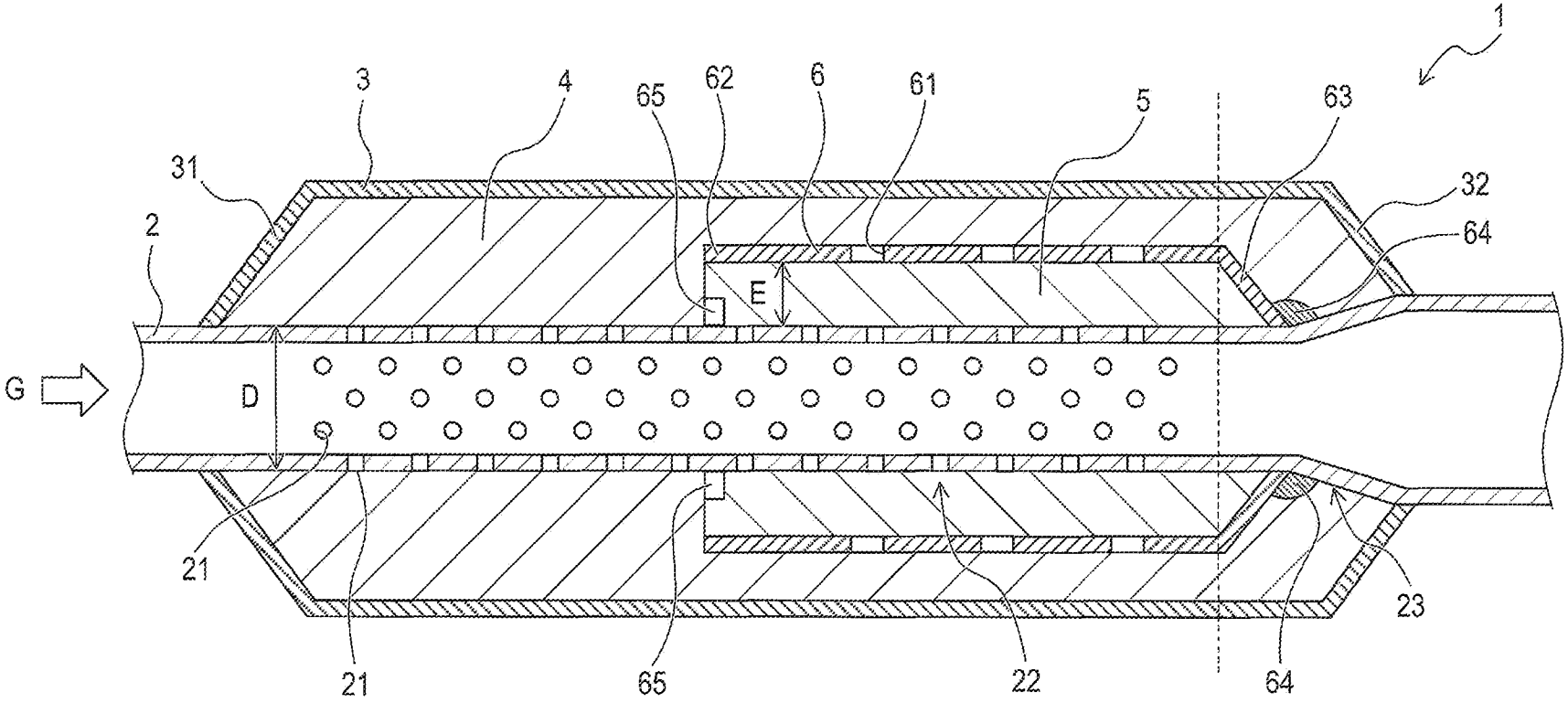
FIG. 2 is a cross-sectional schematic diagram of a muffler of the embodiment.

As shown in FIG. 2, the muffler 1 comprises an exhaust pipe 2, a shell 3, a first sound absorbing material 4, a second sound absorbing material 5, and a cover 6.

<Exhaust Pipe>

The exhaust pipe 2 is a metal pipe allowing exhaust gas G to flow through an interior thereof. As shown in FIG. 1, the exhaust pipe 2 in the present embodiments extends to an interior of the main muffler 13.

As shown in FIG. 2, the exhaust pipe 2 includes communication holes 21, a straight portion 22, and an enlarged diameter portion 23. The communication holes 21 communicate an inside of the exhaust pipe 2 with an outside of the exhaust pipe 2. The straight portion 22 has a constant diameter. The enlarged diameter portion 23 has an enlarged diameter, which is enlarged along a direction in which the exhaust gas G flows.

The communication holes 21 are disposed in a part of the straight portion 22 of the exhaust pipe 2 within the shell 3 and provided entirely on a peripheral surface of the straight portion 22. However, the communication holes 21 need not be necessarily provided entirely on the peripheral surface of the exhaust pipe 2.

Each size of the communication holes 21 and an interval therebetween may be changed as appropriate. However, a total open area of the communication holes 21 is large enough for at least one node in a standing wave to be formed in the exhaust pipe 2 within the shell 3 in configurations in which the cover 6 is not provided. It should be noted that a node of a standing wave is formed in the exhaust pipe 2 inside the shell 3, when sound waves are reflected by the communication holes 21 or when a pressure of the exhaust gas G in the exhaust pipe 2 is reduced by the communication holes 21, that is, it is considered equivalent to a state in which the exhaust pipe 2 is in an open state.

A shape of the communication hole 21 is not limited to a perfect circle, but may be other shapes such as an oval or a polygon. Further, the communication hole 21 may be provided with a louver such that a part of a pipe wall of the exhaust pipe 2 is cut and bent outward.

<Shell>

The shell 3 is a metal pipe disposed outside the exhaust pipe 2 to surround an outer peripheral surface of the exhaust pipe 2. The shell 3 has a cylindrical shape. The shell 3 is disposed outside the communication holes 21 in the exhaust pipe 2 so as to fully cover the communication holes 21. An inner diameter of the shell 3 is larger than an outer diameter of the exhaust pipe 2.

The shell 3 incudes a first opening 31 and a second opening 32, each of which has a smaller diameter toward an outer side of the exhaust pipe 2 in an axial direction. Each of the first opening 31 and the second opening 32 is fixed to the outer peripheral surface of the exhaust pipe 2, for example, by welding. The shell 3 surrounds the outer peripheral surface of the exhaust pipe 2, and is positioned to form a space between the shell 3 and the exhaust pipe 2. The first sound absorbing material 4 and the second sound absorbing material 5, which will be described below, are arranged in the space.

<Cover>

The cover 6 is a cylindrical member in contact with the second sound absorbing material 5 from outside in a radial direction of the exhaust pipe 2. The cover 6 is disposed between the exhaust pipe 2 and the shell 3.

The cover 6 has a tubular shape and covers at least one of the communication holes 21. The cover 6 may cover at least part of the communication holes 21. The cover 6 is disposed between the shell 3 and the exhaust pipe 2. The cover 6 is disposed at a distance E, which is specified in advance, from the exhaust pipe 2. The exhaust pipe 2 and the cover 6 each have a cylindrical body and a common central axis. Further, a diameter of the exhaust pipe 2, in particular, a diameter D of the outer peripheral surface of the exhaust pipe 2 located within the shell 3 and covered with the cover 6, is set to not less than 1.8 times as large as the distance E between the outer peripheral surface of the exhaust pipe 2 and an inner peripheral surface of the cover 6.

Figure 3:
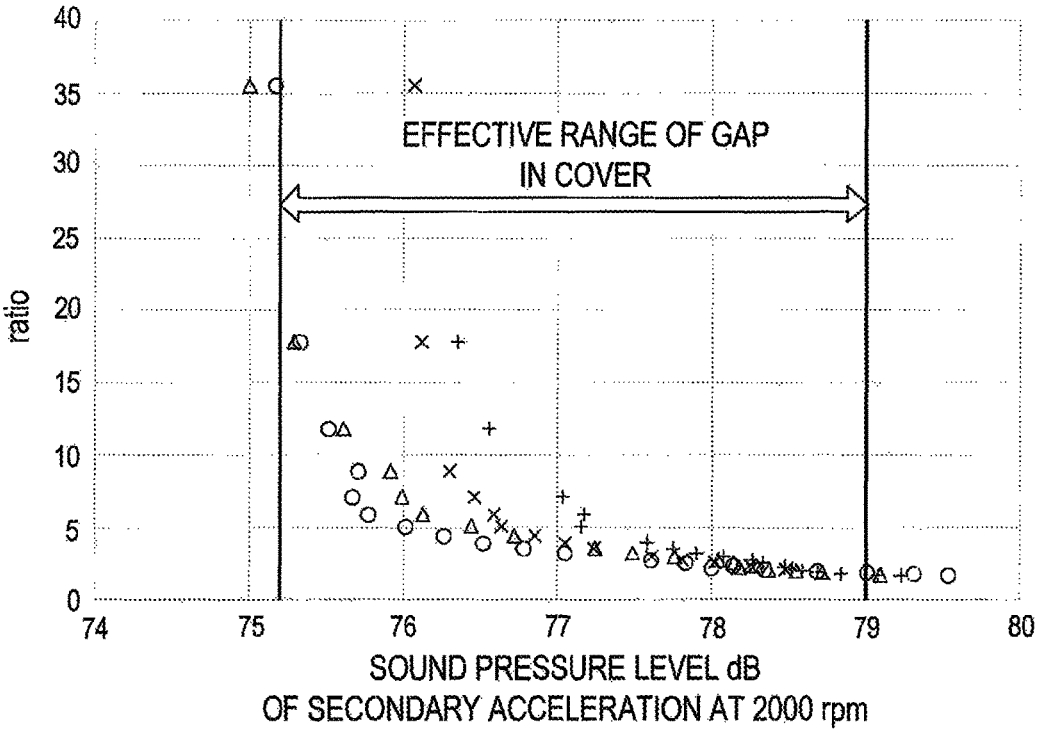
FIG. 3 is a graph showing a relationship between a sound pressure level and a ratio of a diameter of an exhaust pipe to a distance between the exhaust pipe and a cover.

Here, in a graph shown in FIG. 3, the horizontal axis indicates a sound pressure level when the number of revolutions of the internal combustion engine 11 is 2000 rpm, and the vertical axis indicates a ratio of the diameter D of the outer peripheral surface of the exhaust pipe 2 to the distance E between the exhaust pipe 2 and the cover 6. The ratio of the diameter D to the distance E becomes greater as the distance E becomes smaller or as the diameter D becomes greater.

As shown in FIG. 3, the sound pressure level decreases as the ratio of the diameter D to the distance E increases. Here, the sound pressure level is about 79 dB in the configurations in which the cover 6 of the present embodiments is not provided. Referring to FIG. 3, when the ratio of the diameter D to the distance E is 1.8, the sound pressure level is substantially equivalent to the sound pressure level 79 dB. Accordingly, when the ratio of the diameter D to the distance E is 1.8 or more, the sound pressure level is lower than that in the configurations in which the cover 6 is not provided.

The data in examples shown in FIG. 3 were obtained where a maximum ratio of the diameter D to the distance E was determined as 36. Accordingly, when the ratio of the diameter D to the distance E is between 1.8 or more and 36 or less, the sound pressure level can be reduced more than that of the configurations in which the cover 6 is not provided. It should be noted that the maximum ratio of the diameter D to the distance E is determined based on an assembly structure. However, the maximum ratio of the diameter D to the distance E is not limited to 36. For example, the maximum ratio may be greater than 36 if a gap between the exhaust pipe 2 and the cover 6 is sufficient to arrange the second sound absorbing material 5.

The cover 6 includes a first end portion 62 and a second end portion 63, which are fixed to the exhaust pipe 2. The first end portion 62 and the second end portion 63 correspond to both ends of the cover 6 in the axial direction of the exhaust pipe 2. Specifically, the second end portion 63 has a smaller diameter toward a downstream in the direction in which the exhaust gas G flows. An end of the second end portion 63 is fixed to the outer peripheral surface of the exhaust pipe 2 by a fixing portion 64, for example, by welding. The second end portion 63 is an end portion of the cover 6 in the axial direction of the exhaust pipe 2. The second end portion 63 is positioned downstream in the direction in which the exhaust gas G flows.

The first end portion 62 does not taper and is fixed to the outer peripheral surface of the exhaust pipe 2, for example, by a connection member 65. The connection member 65 connects the first end portion 62 with the exhaust pipe 2. The first end portion 62 is the other end portion of the cover 6 in the axial direction of the exhaust pipe 2. The first end portion 62 is positioned upstream in the direction in which the exhaust gas G flows.

The connection member 65 is made of, for example, a metal rod. One end of the connection member 65 is fixed to the exhaust pipe 2, and the other end is fixed to the cover 6, thereby fixing the cover 6 to the exhaust pipe 2. The connection member 65 does not completely seal a gap, which is provided at the first end portion 62, between the cover 6 and the exhaust pipe 2, and partially remains the gap therebetween. Accordingly, the first end portion 62 is configured as an open end, which includes a gap between the exhaust pipe 2 and the cover 6. In other words, the connection member 65 is fixed to the exhaust pipe 2 in a state where the first end portion 62 of the cover 6 is open.

Further, the cover 6 includes auxiliary holes 61, which are disposed in a part facing the outer peripheral surface of the exhaust pipe 2. Each of the auxiliary holes 61 penetrates the cover 6 such that a space on a side where the exhaust pipe 2 is disposed is communicated with a space on a side where the shell 3 is disposed.

The communication holes 21 are not formed in a part of the outer peripheral surface of the exhaust pipe 2, to which the second end portion 63 is fixed. The communication holes 21 are formed in the exhaust pipe 2 only upstream from the most upstream part of the second end portion 63, that is, only in a more upstream side than a part defined by a dotted line in FIG. 2.

<Sound Absorbing Material>

The first sound absorbing material 4 is disposed between the exhaust pipe 2 and the shell 3 to cover some of the communication holes 21.

Specifically, the first sound absorbing material 4 is disposed in an area nearby the first opening 31 of the shell 3, on the straight portion 22 of the exhaust pipe 2. In other words, the first sound absorbing material 4 is disposed so as to circumferentially surround an upstream part of the straight portion 22 of the exhaust pipe 2. The first sound absorbing material 4 is in contact with some of the communication holes 21 positioned upstream.

The first sound absorbing material 4 and the second sound absorbing material 5, which is described below, fills a space between the exhaust pipe 2 and the shell 3. Thus, no empty space between the exhaust pipe 2 and the shell 3 remains. Further, the first sound absorbing material 4 is disposed so as to reach an inner peripheral surface of the shell 3 from the outer peripheral surface of the exhaust pipe 2 in the radial direction of the exhaust pipe 2.

As a material of the first sound absorbing material 4, inorganic fibers such as glass fibers, may be used, for example. In some embodiments, an inorganic fiber assembly such as glass wool, an inorganic fabric, an inorganic knitting, a nonwoven inorganic fabric, or a structural body of inorganic fabrics partially bonded with a binder may be used as the first sound absorbing material 4.

The second sound absorbing material 5 fills a space between the cover 6 and the exhaust pipe 2. The second sound absorbing material 5 has a greater ventilation resistance than the first sound absorbing material 4. For example, the second sound absorbing material 5 contains a material with a higher density than the first sound absorbing material 4 and/or with a greater ventilation resistance than the first sound absorbing material 4. The first sound absorbing material 4 also fills a space between the cover 6 and the shell 3. Accordingly, in the present embodiments, the first sound absorbing material 4 is disposed outside the second sound absorbing material 5 in the radial direction of the exhaust pipe 2.

However, the first sound absorbing material 4 and the second sound absorbing material 5 may be interchanged in position, that is, replaced with each other. The first sound absorbing material 4 may be same as the second sound absorbing material 5, or no sound absorbing material may be provided inside the cover 6.

In an upstream area of the muffler 1, the first sound absorbing material 4 alone is disposed in the radial direction of the exhaust pipe 2. In an area where the cover 6 is disposed in the muffler 1, the second sound absorbing material 5 and the first sound absorbing material 4 are formed in a two-layered structure in the radial direction of the exhaust pipe 2.

All communication holes 21 in the exhaust pipe 2 are covered with either the first sound absorbing material 4 or the second sound absorbing material 5.

1-2. Operation

As shown in FIG. 1, in a case where the exhaust pipe 2 in the muffler 1 includes no communication hole 21, a standing wave W1 of the exhaust gas G is generated within the exhaust pipe 2 in the exhaust system 10.

The standing wave W1 has a waveform in a first mode in which both ends of the exhaust pipe 2 are nodes. A node of a standing wave is formed in a portion where pressure decreases significantly. For example, the node is formed in a part where an end portion of the exhaust pipe 2 is radially enlarged, or where the exhaust pipe 2 is open. Further, a node of the standing wave is formed in an area where the total open area of the communication holes 21 in the exhaust pipe 2 is relatively large with respect to, for example, a cross-sectional area of a flow passage of the exhaust pipe 2. In this area, a sound pressure within the exhaust pipe 2 is decreased or the sound waves are reflected by the communication holes 21, and thus a node of the standing wave is formed.

On the other hand, if the communication holes 21 in the exhaust pipe 2 where the standing wave W1 is generated are covered with the first sound absorbing material 4 alone without the cover 6, the exhaust gas G is discharged from the communication holes 21. This causes decrease in the sound pressure within the exhaust pipe 2 or leads to reflection of the sound waves, thereby to generate two standing waves W2 and W3 within the exhaust pipe 2, instead of the standing wave W1. A node S shown in FIG. 1 represents a point where a node of the standing wave W2 is formed identical to a point where a node of the standing wave W3 is formed. When some among the communication holes 21 that are in a position corresponding to the node S are covered with the second sound absorbing material 5, a standing wave W4 is generated, instead of the two standing waves W2 and W3. The position corresponding to the node S indicates a positon on a radially outer side of the exhaust pipe 2 relative to the node S. For the following reasons, the standing wave W4, instead of the two standing waves W2 and W3, is generated. Specifically, covering the communication holes 21 with the cover 6 substantially reduces the total open area of the communication holes 21, thereby reducing a discharge amount of the exhaust gas G to be discharged outside the exhaust pipe 2. The reduction in the discharge amount of the exhaust gas G inhibits a sound pressure from decreasing, thereby making it less likely to form the node S. Further, the cover 6 restricts refection of the sound waves, which are reflected by the communication holes 21, making it less likely to form the node S. In the case of the standing wave W4, the sound pressure within the exhaust pipe 2 decreases more. Thus, the sound pressure of the standing wave W4 is lower than those of the three standing waves W1, W2, and W3.

1-3. Effects

In the embodiments described above, the following effects can be obtained.

(1a) In one embodiment of the present disclosure, the muffler 1 comprises the exhaust pipe 2, the shell 3, and the cover 6. The exhaust pipe 2 includes the communication holes 21 and is configured to allow the exhaust gas G to flow through the interior of the exhaust pipe 2. The shell 3 is disposed outside the communication holes 21 to cover the communication holes 21. The cover 6 is tubular and covers at least one of the communication holes 21. The cover 6 is disposed between the exhaust pipe 2 and the shell 3 at a distance, which is specified in advance, from the exhaust pipe 2.

In the configuration as described above, the cover 6 is placed in a position where a node of the standing wave is formed. This restricts reflection of the sound waves in an area where the cover 6 overlaps the communication holes 21 in the exhaust pipe 2, thereby reducing generation of a node of the standing wave, comparing with a case in which the communication holes 21 are covered with the shell 3 alone. As a result, the configuration as described above enables the muffling effect in a specific frequency while reducing generation of a standing wave with a new frequency.

Figure 4:
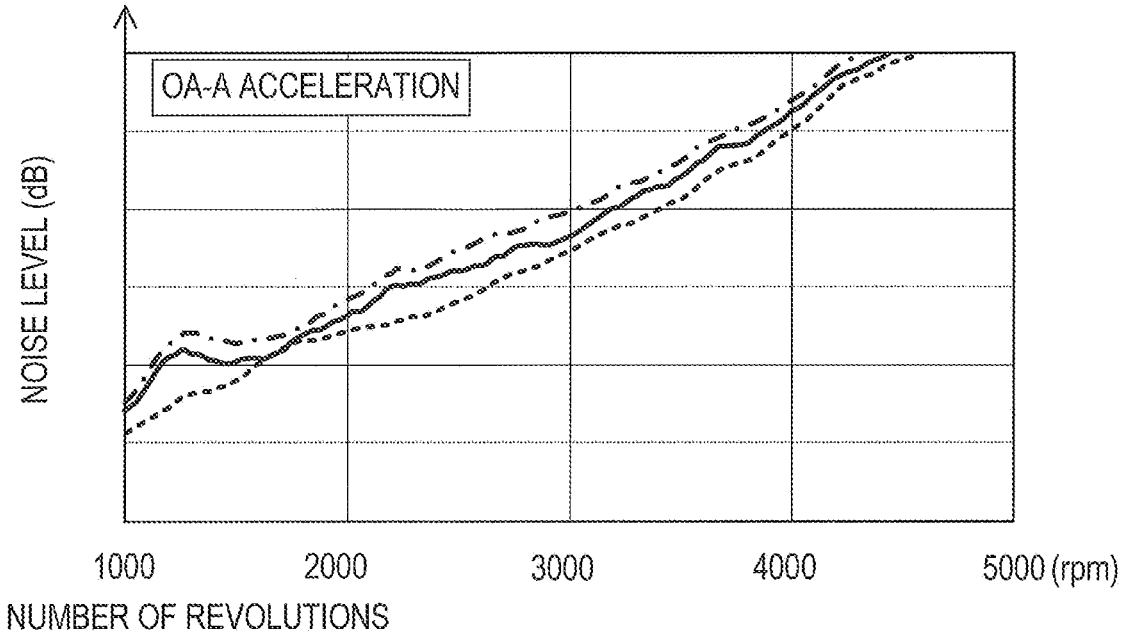
FIG. 4 is a graph showing a relationship between the number of revolutions of an internal combustion engine and a noise level.

In FIG. 4, the graph shows a relationship between the number of revolutions of the internal combustion engine 11 and a noise level. The noise level shown in the graph is a comprehensive noise level in an entire frequency band. Specifically, the noise level is a volume of sounds when noise was picked up by a microphone.

Figure 5:
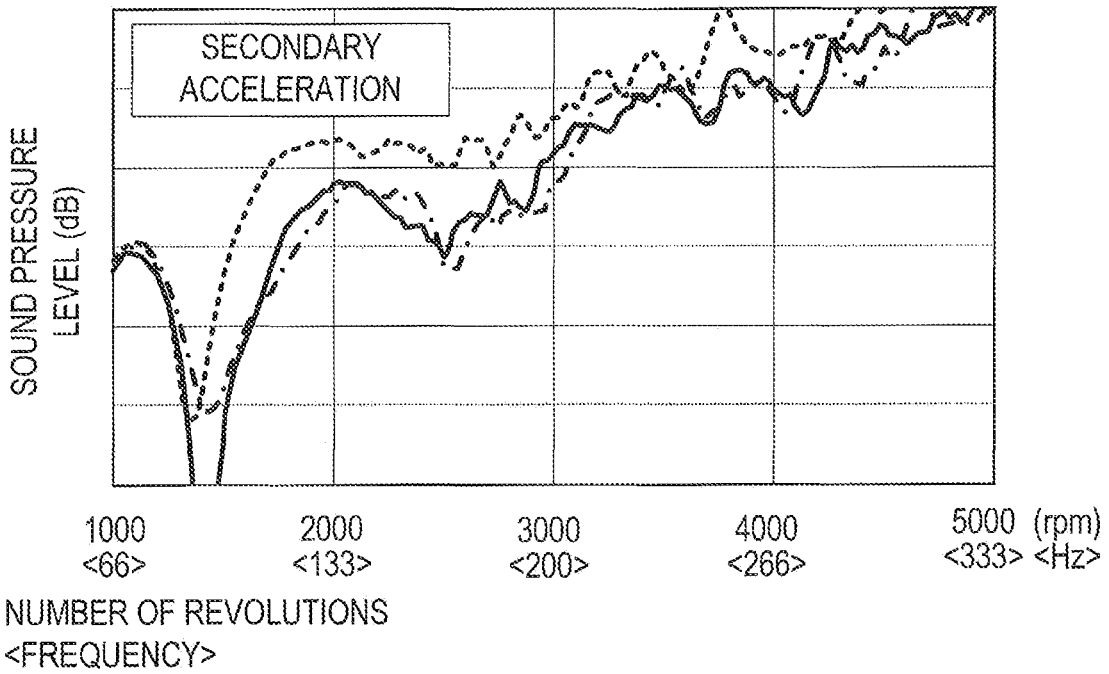
FIG. 5 is a graph showing a relationship between the number of revolutions of the internal combustion engine and a sound pressure level in a specific frequency.

In FIG. 5, the graph shows a sound pressure level of a specific frequency component per number of revolutions of the internal combustion engine 11. This graph shows a secondary explosion component, assuming that the internal combustion engine 11 a four-cylinder engine, and further indicates sound pressure levels of the frequency component to which 66 Hz is added every time the number of revolutions of the internal combustion engine 11 is increased by 1000 revolutions. Specific frequency components are, for example, 66 Hz when the number of revolutions of the internal combustion engine 11 is 1000, and 133 Hz when the number of revolutions of the internal combustion engine 11 is 2000.

In the graphs shown in FIG. 4 and FIG. 5, a solid line indicates a measurement result of the configuration of the present embodiments, and the other two types of dashed lines indicate measurement results of conventional configurations in each which the cover 6 is not provided. Specifically, a short dashed dotted line indicates the measurement result of a first conventional configuration, in which the number of the communication holes 21 is same as that of the configuration of the present embodiments. Further, a long dashed dotted line indicates the measurement result of a second conventional configuration, in which the number of the communication holes 21 is smaller than those of the configurations of the present embodiments.

As shown in FIG. 4, the first conventional configuration (indicated by the short dashed dotted line) can limit comprehensive noise levels more than the configurations of the present embodiments. However, it cannot limit the sound pressure levels in the specific frequency components in the first conventional configuration, which is indicated by the short dashed dotted line, as much as the other two configurations of the present embodiments (indicated by the solid line) and the second conventional configuration (indicated by the long dashed dotted line), as shown in FIG. 5. Further, FIG. 5 shows that the second conventional configuration can limit the sound pressure levels in the specific frequency components as much as the configurations of the present embodiments. On the other hand, FIG. 4 shows that the second conventional configuration cannot limit the comprehensive noise levels as much as the configurations of the present embodiments.

That is, from the above-described measurement results shown in FIG. 4 and FIG. 5, it is proved that the configurations of the present embodiments limit the comprehensive noise levels as appropriate, thereby to enable the muffling effect in a specific frequency while reducing generation of a standing wave with a new frequency.

(1b) In one embodiment of the present disclosure, each of the exhaust pipe 2 and the cover 6 has a cylindrical shape and a common central axis. Further, the diameter of the exhaust pipe 2 is set to not less than 1.8 times as large as a distance between the exhaust pipe 2 and the cover 6.

By such a configuration, a higher muffling effect can be achieved, comparing with the conventional configurations.

(1c) In one embodiment of the present disclosure, both ends of the cover 6 in the axial direction of the exhaust pipe 2 may be fixed to the exhaust pipe 2.

By such a configuration, misalignment and vibrations of the cover 6 can be limited. This further enhances an inhibiting effect on generation of a node of a standing wave and increases the muffling effect.

(1d) In one embodiment of the present disclosure, at least one of the both ends of the cover 6 in the axial direction of the exhaust pipe 2 is configured as an open end, which includes the gap between the cover 6 and the exhaust pipe 2.

In the configuration as described above, the gap between the exhaust pipe 2 and the cover 6 is formed around the open end of the cover 6, which is open to an outer peripheral surface of the exhaust pipe 2. In this case, an opening (gap) of the open end of the cover 6 may also serve as one of the auxiliary holes 61. Accordingly, an area available for forming the auxiliary holes 61 is increased in the cover 6, thereby allowing for facilitation of the muffling effect in the muffler 1.

(1e) In one embodiment of the present disclosure, the cover 6 includes the auxiliary holes 61 disposed in a part facing the outer peripheral surface of the exhaust pipe 2.

By such a configuration, a flow of the exhaust gas G between the cover 6 and the shell 3 can be ensured. Consequently, the exhaust gas G is expanded between the cover 6 and the shell 3, thereby allowing for facilitation of the muffling effect.

(1f) In one embodiment of the present disclosure, the muffler 1 further comprises the second sound absorbing material 5 disposed between the exhaust pipe 2 and the cover 6. The second sound absorbing material 5 covers the communication holes 21.

By such a configuration, the second sound absorbing material 5 limits vibrations produced by the exhaust gas G, thereby allowing for facilitation of the muffling effect.

Further, when ventilation resistance of the second sound absorbing material 5 is greater than that of the first sound absorbing material 4, it is likely to reliably generate the standing wave W4, instead of the standing waves W2 and W3, owing to the second sound absorbing material 5.

2. Other Embodiments

Embodiments of the present disclosure have been described hereinabove. Nevertheless, the present disclosure is not limited to the aforementioned embodiments. The present disclosure can be embodied in various forms.

Figure 6:
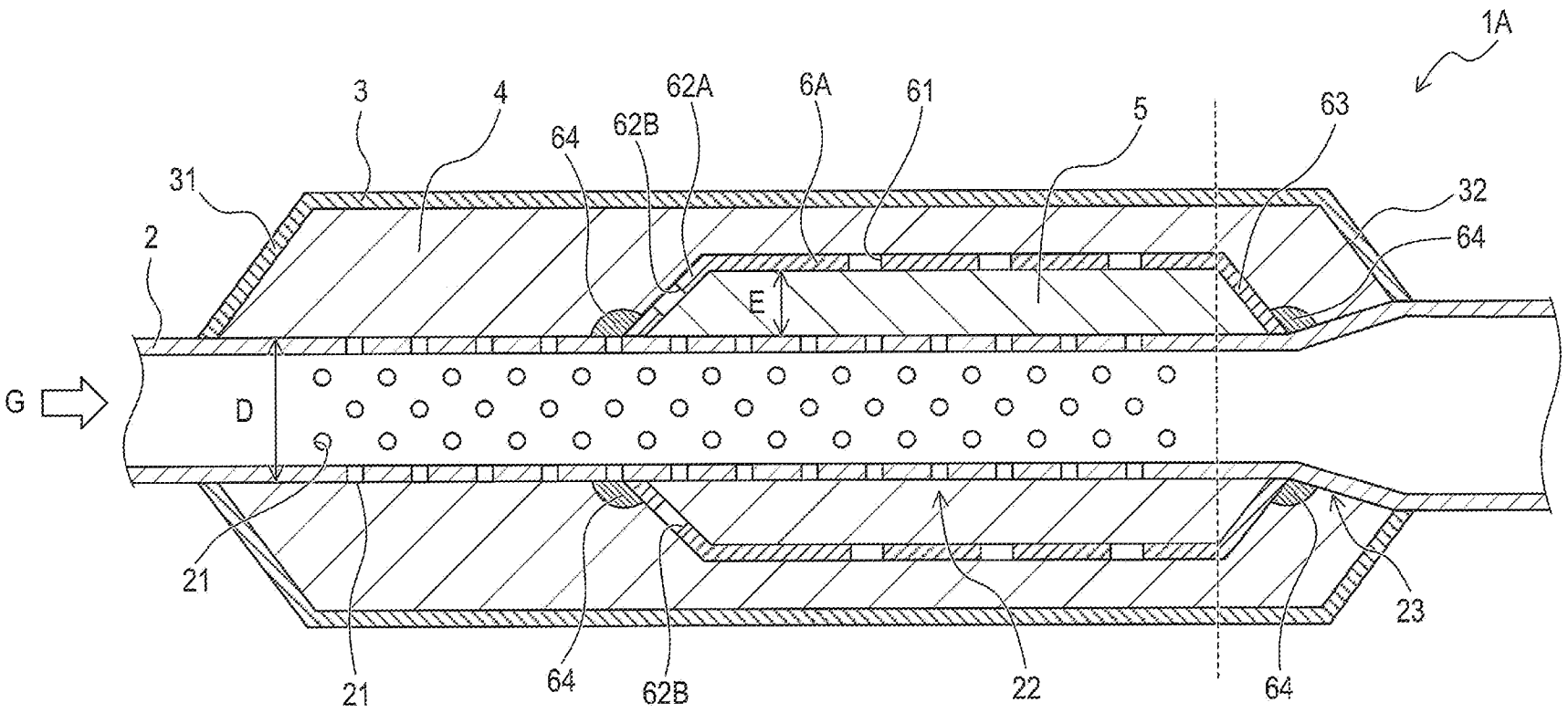
FIG. 6 is a cross-sectional schematic diagram of a muffler of another embodiment.

(2a) In the muffler 1 in the embodiment as described above, the first end portion 62, which is one end of the cover 6, is defined to be open; however, the first end portion 62 is not limited to such configuration. For example, as shown in FIG. 6, a first end portion 62A has a smaller diameter toward an upstream in the direction in which the exhaust gas G flows, and the end may be fixed to the outer peripheral surface of the exhaust pipe 2 by the fixing portion 64, for example, by welding. In this case, auxiliary holes 62B may be formed in the first end portion 62A. Like the above-described auxiliary holes 61, the auxiliary holes 62B have function of ensuring a flow of the exhaust gas G between the cover 6A and the shell 3.

(2b) The muffler 1 in the embodiment as described above is configured such that one end of the cover 6 is defined as an open end; however, both ends of the cover 6 may be defined as open ends.

(2c) The muffler 1 in the embodiment as described above comprises the first sound absorbing material 4, the second sound absorbing material 5, the auxiliary holes 61, and the connection member 65; however, they need not be included in a muffler. If the muffler does not include the connection member 65, the cover 6 may be fixed to the exhaust pipe 2 by only one end, i.e., only the second end portion 63, or a partial or an entire portion of the cover 6 may be fixed to the exhaust pipe 2 via the second sound absorbing material 5.

(2d) In the muffler 1 in the embodiment as described above, an upstream and a downstream may be exchanged. In other words, an upstream end and a downstream end of the muffler 1 may be reversed.

(2e) Functions of one component in the aforementioned embodiments may be distributed to two or more components. Functions of two or more components may be integrated and achieved by one component. At least a part of the configurations of the aforementioned embodiments may be replaced with known configurations having the same functions. A part of the configurations of the aforementioned embodiments may be omitted. At least a part of the configurations of aforementioned embodiments may be added to or replaced with other configurations of another one of the aforementioned embodiments. Any and all modes that are encompassed in the technical ideas identified by the languages in the claims are embodiments of the present disclosure.

What is claimed is:

1. A muffler comprising:

an exhaust pipe including communication holes and configured to allow an exhaust gas to flow through an interior of the exhaust pipe;

a shell disposed outside the communication holes to cover the communication holes;

a cover having a tubular shape and disposed between the exhaust pipe and the shell at a specific distance from the exhaust pipe, the cover covering at least one of the communication holes;

a first sound absorbing material that fills a space between the shell and the cover; and a second sound absorbing material that fills a space between the exhaust pipe and the cover;

wherein all of the communication holes are covered with either the first sound absorbing material or the second sound absorbing material;

wherein the first sound absorbing material and the second sound absorbing material abut an outer peripheral surface of the exhaust pipe at different locations along an axial direction of the exhaust pipe; and wherein some of the communication holes are covered with a part of the first sound absorbing material that abuts the outer peripheral surface of the exhaust pipe, and the other communication holes are covered with a part of the second sound absorbing material that abuts the outer peripheral surface of the exhaust pipe.

2. The muffler according to claim 1, wherein each of the exhaust pipe and the cover has a cylindrical shape and a common central axis, and wherein a diameter of the exhaust pipe is at least 1.8 times as large as a distance between the exhaust pipe and the cover.

3. The muffler according to claim 1, wherein opposing first and second ends of the cover in the axial direction of the exhaust pipe are fixed to the exhaust pipe.

4. The muffler according to claim 1, wherein at least one of opposing first and second ends of the cover in the axial direction of the exhaust pipe is formed as an open end, the open end including a gap between the cover and the exhaust pipe.

5. The muffler according to claim 1, wherein the cover includes auxiliary holes disposed in a portion facing an outer peripheral surface of the exhaust pipe.

6. The muffler according to claim 1, wherein the second sound absorbing material has a greater ventilation resistance than the first sound absorbing material.

* * * * *